US007120958B2

(12) United States Patent
Copeskey et al.

(10) Patent No.: US 7,120,958 B2
(45) Date of Patent: Oct. 17, 2006

(54) MASS PRODUCIBLE CUSTOM-MADE SHOE INSERTS

(76) Inventors: Paul Copeskey, 2498 Mandeville Canyon Rd., Los Angeles, CA (US) 90049; Megan Lee, 2498 Mandeville Canyon Rd., Los Angeles, CA (US) 90049

( * ) Notice: Subject to any disclaimer, the term of this patent is extended or adjusted under 35 U.S.C. 154(b) by 248 days.

(21) Appl. No.: 10/804,687

(22) Filed: Mar. 19, 2004

(65) Prior Publication Data

US 2004/0181976 A1 Sep. 23, 2004

Related U.S. Application Data

(60) Provisional application No. 60/455,815, filed on Mar. 19, 2003.

(51) Int. Cl.
*A43B 3/24* (2006.01)
*A43B 13/20* (2006.01)

(52) U.S. Cl. ..... 12/142 N; 12/146 M; 36/140

(58) Field of Classification Search ..... 12/142 N, 12/146 M, 142 R; 36/140, 166, 88, 93, 44, 36/43

See application file for complete search history.

(56) References Cited

U.S. PATENT DOCUMENTS 6,141,889 A * 11/2000 Baum ..... 36/140
6,331,893 B1 * 12/2001 Brown et al. ..... 356/601
6,463,351 B1 * 10/2002 Clynch ..... 700/163
6,823,550 B1 * 11/2004 Kantro ..... 12/142 N
2002/0071597 A1 * 6/2002 Ravitz et al. ..... 382/111
2002/0138923 A1 * 10/2002 Shaffeeullah ..... 12/142 N
2002/0162250 A1 11/2002 Campbell et al.
2003/0079303 A1 * 5/2003 Kantro ..... 12/142 N
2003/0140525 A1 7/2003 Branger

* cited by examiner

*Primary Examiner*—Marie Patterson
(74) *Attorney, Agent, or Firm*—Kenneth L. Sherman, Esq.; Myers, Dawes, Andras & Sherman, LLP

(57) ABSTRACT

A design concept for foot orthotics having several different optional features and sub-features is disclosed. The design is useful for supporting and correcting abnormal foot posture. The disclosure contemplates different types of footwear in addition to user's gender, age, weight, foot size, activity level and medical condition. Varying types of midfoot sections and heel portions are employed having specific arch support. The design further provides the benefits of custom foot casting while having mass producible parts. Also disclosed are design choices for thickness and width of the orthotics and preferred materials for a wide range of applications. Additionally, a method is disclosed for choosing particular orthotics for a particular person from a set of total possible orthotics available. The set of orthotics will contain sub-sets of specific arch heights, widths and thicknesses of orthotics.

8 Claims, 9 Drawing Sheets

| | AVERAGE RANGES (mm) | | |
|---|---|---|---|
| | LOW AVG. | HIGH AVG. | OPTIMAL AVG. |
| *PARAMETERS* | | | |
| **Thickness (Density)** | | | |
| Flexible | 2.7781 | 3.5719 | 3.1750 |
| Semi-Flexible | 3.5719 | 4.3656 | 3.9688 |
| Stiff | 4.3656 | 5.1594 | 4.7625 |
| Rigid | 5.1594 | 7.1438 or higher | 6.3500 |
| **Width** | | | |
| Narrow | 40 or narrower | 85 | 70 |
| Regular | 45 | 95 | 80 |
| Wide | 50 | 130 or higher | 90 |
| **Arch Height** | | | |
| Low | 10 or lower | 30 | 20 |
| Medium | 15 | 45 | 25 |
| High | 20 | 60 or higher | 30 |

| | *AVERAGE RANGES (mm)* | | |
|---|---|---|---|
| | LOW AVG. | HIGH AVG. | OPTIMAL AVG. |
| *PARAMETERS* | | | |
| **Thickness (Density)** | | | |
| Flexible | 2.7781 | 3.5719 | 3.1750 |
| Semi-Flexible | 3.5719 | 4.3656 | 3.9688 |
| Stiff | 4.3656 | 5.1594 | 4.7625 |
| Rigid | 5.1594 | 7.1438 or higher | 6.3500 |
| **Width** | | | |
| Narrow | 40 or narrower | 85 | 70 |
| Regular | 45 | 95 | 80 |
| Wide | 50 | 130 or higher | 90 |
| **Arch Height** | | | |
| Low | 10 or lower | 30 | 20 |
| Medium | 15 | 45 | 25 |
| High | 20 | 60 or higher | 30 |

FIG. 7

| Order Date: | PLEASE SPECIFY | |
|---|---|---|
| **CUSTOMER Information** | Shoe Size | Body Wt. |
| Name _____<br>Age_____ ---------- Type of exersice_____<br>Minutes / Week exercising_____<br>Shipping Address _____<br>City/Zip Code _____<br>TEL ( ) _____ FAX ( ) _____ | Men's<br>Women's | |

MASS PRODUCIBLE CUSTOM-MADE SHOE INSERTS

PRIORITY CLAIM

This patent application claims the benefit of the priority date of U.S. Provisional Patent Application Ser. No. 60/455,815 filed on Mar. 19, 2003 and entitled Mass Producible Custom-Made Shoe Inserts pursuant to 35 USC §119, the entire contents of this provisional patent application are hereby expressly incorporated by reference.

BACKGROUND OF THE INVENTION

1. Field of the Invention

The present invention pertains generally to shoe inserts. More particularly, the present invention pertains to orthotics useful for accommodating and treating foot abnormalities and methods thereof for mass producing orthotics in a manner choosing specific orthotics for a specific person. The preferred embodiments of the present invention are particularly, but not exclusively, useful as custom-made orthotics having selectable support portions, the orthotics being mass-producible.

2. Description of the Prior Art

Biomechanics relating to the human foot and potential abnormalities thereof are well known. FIG. 1 illustrates a skeletal bone structure of a human foot 10 composed of twenty-six bones that articulate with respect to one other by means of joints. The skeletal arrangement of the foot 10 provides for flexible support for the weight of the entire body. There are seven tarsal bones 2, the largest and the strongest of which is the calcaneus 4 (or heel bone), and serves to transmit the weight of the body to the ground and forms a strong lever for the calf muscle. The metatarsals 6, or sole and instep of the foot 10, is formed by five bones, each articulating with the tarsal bones 2 by one extremity, and by the other with the first row of phalanges 8.

The tarsal 2 and metatarsal 6 bones each form two distinct arches. As illustrated in FIG. 2, the first is the longitudinal or the plantar arch 11 that runs from the heel 4 to the ball 12 on the inner (medial) side and underside aspect of the foot 10. The other arch is a transverse arch across the forefoot in the metatarsal region 6.

Over-pronation, or flatfeet, is a common biomechanical problem that occurs in the walking process when a person's plantar arch 11*a* collapses upon weight bearing, as illustrated in FIG. 3A. Such over-pronation is a very common structural deformity in which there is outward rotation of the heel 4 (as shown in FIG. 3C) lowering the longitudinal arch 11*a*, displacing of the head of the first metatarsal dorsally, pronating and abducting of the distal part of the foot 10, resulting in an everted position of the heel. This movement can cause extreme stress or inflammation on the plantar fascia, potentially further causing severe discomfort and leading to other foot problems. Pain may be present in the plantar arch 11*a* or frequently localized in the area behind the medial malleolus. This results in the radiation of pain to the Achilles tendon, medial and posterior calf muscles, or up to the shin, knee, hip, and lower back.

As viewed from the bottom of the foot 10, FIG. 3B illustrates a height of a longitudinal arch 11 by comparing the position of an arch line AR or AR' of the footprint with respect to the position of the reference line X, which is a straight line extending from the center of the second toe 13 to the center of the heel end 15. When the arch line of a footprint is above the reference line X as shown by the dotted line AR', the foot arch 10 is estimated to be relatively low. On the other hand, when the arch line of a footprint is below the reference line X as shown by the solid line AR, the foot arch 10 is estimated to be relatively high. Line X is used as a base line in the estimation due to the weight of a person being typically concentrated near the second toe 13 and near the outer portion of the heel end 15 during walking or running.

The body's kinetic chain of imbalance starts with abnormally low arched feet meeting the ground, followed by a cascade of interdependent physical reactions involving twisting, pulling and compressing of predictable muscle groups, tendons, ligaments, and bones from the bottom of the feet to the top of the skull. The abnormal position of the feet (low arch height AR') does not allow physical stress to travel vertically from the feet upwards towards the hip sockets. Therefore, as is illustrated in FIG. 3C viewing from the rear of a user's feet, the vertical stress line 14 of heel 4 for a flatfoot forms an acute angle to the ground, and is not at a perpendicular thereto.

Flatfeet can potentially lead to a variety of diseases including for example, plantar fasciitis, metatarsalgia, sesamoiditis, Morton's neuroma, heel spurs, achilles tendinitis, posterior tibial tendinitis, shin splints, bunions, knee, leg, hip, lower and upper back, shoulder, and neck pains, including headaches, and others. Heretofore, shoe inserts or insoles have been used to alleviate some of the pain caused by flatfeet. However, the prior art insoles are not a corrective measure, but merely an accommodating one. In other words, the insoles do not correct arch deformities; but rather merely accommodate to help alleviate some of the pain caused by the deformity.

Generally in the orthotic art, in order to make custom-made shoes or insoles for flatfeet, a cast is first taken of a foot using a plaster bandage. Next, custom-made orthotics or insoles are made by molding over the plaster foot cast with synthetic resins or other materials. Of concern, some of the materials used for the construction of the prior art orthotics are not suitable for insoles; they may include leather, graphite, cork, steel, aluminum, and even wood. Furthermore, the prior art orthotics require too much time and often-complicated procedures to make, and are costly. Moreover, it is impossible to mass-produce plaster casted orthotics.

Other processes contemplated in the art include analyzing the foot's individual pressure points with respect to the ground to make an insole with a structure (or shape) that accommodates those measured pressure points. Accordingly, pre-molded insoles are produced that comprise individual pads for each of these pressure points. These may include a pair of flat insole plates that have a convex shape corresponding to the arch of the sole, a pair of forefoot pads accompanying each of the insole plates, a pair of rear-foot pads, a pair of longitudinal pads, and further a pair of auxiliary pads. All are to be attached on the insole plates to compensate the uneven contact of the foot with the ground. Although mass producible, the pad accompanying plates have problems fitting certain feet. Many parameters are required to be considered when these pads are attached on the insole plate, such as structural or anatomical foot variances, or the almost impossible task to control the foot angle to the ground surface with semi-pronating or hyper-pronating feet. Therefore, there is a strong need for advancement in shoe insoles (i.e. orthotics) that are easily employed inside shoes, and a means of foot correction and underfoot comfort for the abnormal foot.

In light of the above, it is an object of the present invention to provide a design of orthotics that is able to be custom made and adaptable to a particular user's needs based on factors such as type of footwear in addition to user's age, weight, foot size, activity level and foot abnormality.

It is yet a further object of the present invention to provide an orthotic having design choices for thickness of and rigidity of material.

Yet another object of the present invention is to provide a system of assembling custom made, mass producible orthotics that is easy to manufacture, relatively simple to use and comparatively cost effective.

BRIEF SUMMARY OF THE INVENTION

A first preferred embodiment of the present invention is an orthotic insertable in footwear generally in the shape of a shoe, the orthotic comprising: a midfoot portion having an apex and forming an arch height; and a heel portion aft of the midfoot portion, the heel portion being generally hook-shaped.

The first preferred orthotic embodiment is further characterized in that the generally hook-shaped heel portion can be flexed, in a direction inward or a direction outward, for insertion into footwear. The orthotic described herein may further comprise a top cover portion covering and generally forward of the midfoot portion and extending around the midfoot portion to the heel portion. Optionally, the top cover portion instead matches the exact shape of the midfoot portion and the heel portion. The arch height is designed to correct abnormalities associated with over-pronation.

The orthotic of the first preferred embodiment may be specifically designed for a dress shoe or a high-heeled shoe. Further, the orthotic may be composed from non-stressed relieved polypropylene material.

A second preferred embodiment of the present invention may be characterized as an orthotic insertable in footwear generally in the shape of a shoe, the orthotic comprising: a midfoot portion having an apex and forming an arch height; and a heel portion aft of the midfoot portion, the heel portion having a heel hole.

The second preferred embodiment may further comprise a top cover portion covering and generally extending forward of the heal portion and midfoot portion. Also, the top cover may have a recessed portion corresponding to the heel hole.

In all of preferred embodiments herein disclosed, the top cover portion may comprise poron material having a thickness of approximately 1/16 of an inch. Optionally, the top cover may comprise poron material having a thickness of approximately 1/8 of an inch. Also alternatively, the top cover comprises spenco material having a thickness of approximately 1/16 or 1/8 of an inch. Any of the orthotics may further have a metatarsal pad generally placed near a forward end of the orthotic wherein the metatarsal pad provides extra padding underneath a ball of a foot.

A third preferred embodiment of the invention may be characterized as an orthotic insertable in footwear generally in the shape of a shoe, the orthotic comprising: a center portion extending from a heel end to forward of an arch height; a top cover generally covering the center portion and extending from the heel end; and a heel posting generally connected underneath the center portion at the heel end.

In the third preferred embodiment, the top cover is generally the same size and shape as the center portion, or, in an alternative structure the top cover could extend from the heel end beyond the center portion to a toe end. As an optional feature, the heel end may form a full heel cup.

A fourth preferred orthotic of the present invention may also include a heel cover connected on a bottom side of the heel posting. The heel posting may be made from crepe material. This fourth preferred orthotic of the present invention may optionally have a thickness and strength of material configured for a heavy person. Additionally, this fourth preferred orthotic has a width that is chosen to be generally narrow, regular, or wide, each width further chosen to match various shoe sizes, wherein the orthotic is mass producible. The arch height of an orthotic disclosed herein may further be chosen based on foot condition, age, and activity level.

The apparatus and method has or will be described for the sake of grammatical fluidity with functional explanations. However, it is to be expressly understood that the claims, unless expressly formulated under 35 USC 112, are not to be construed as necessarily limited in any way by the construction of "means" or "steps" limitations. They are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention and its embodiments can be better visualized by turning now to the following drawings wherein like elements are referenced by like numerals.

The orthotics of the present preferred embodiment of the invention may also be characterized into four (4) classifications of flexibility. In the preferred embodiment an orthotic is generally flexible when it has a thickness approximately in the range of 2.8 to 3.6 millimeters. In yet another classification the orthotic is considered generally semi-flexible and has a thickness approximately in the range of 3.6 to 4.4 millimeters. In still another classification, the orthotic is considered generally stiff and has a thickness approximately in the range of 4.4 to 5.2 millimeters. In yet still another classification, the orthotic is considered generally rigid and has a thickness approximately in the range of 5.2 to 7.1 millimeters.

The present invention may also be embodied in a preferred method for choosing particular orthotics for a particular person, the orthotics being mass producible, the method comprising: gathering physical characteristics of the person; providing the person's weight bearing footprint information; using the footprint information to select one of a plurality of arch heights; using the physical characteristics to select one of a plurality of orthotic material thicknesses; and using the footprint information to select one of a plurality of orthotic widths. A further step may be included where a total of possible combinations of orthotics available is equal to an actual number for the plurality of arch heights times an actual number for the plurality of orthotic material thicknesses times an actual number of the plurality of orthotic widths, and wherein the total of possible combinations of orthotics is mass producible.

More particularly, the step of gathering physical characteristics of the person may comprise: gathering person's age; gathering person's weight; gathering person's physical activity level; and gathering patent's special medical condition.

Additionally, the step of providing the person's footprint information may comprise: having the person stand on a piece of paper with wet bare feet for approximately five (5) seconds forming a wet impression on the piece of paper; and outlining the wet impression on the piece of paper with a pen or a pencil.

The plurality of arch heights may additionally be considered to comprise: low; medium-low; medium; medium-high; and high arch heights. Also, the plurality of orthotic material thicknesses comprise: 1/8 inch; 9/64 inch; 3/16 inch; 11/64 inch; and 1/4 inch thicknesses. Similarly, the plurality of widths comprise narrow, narrow to regular; regular; regular to wide; and wide widths.

In a preferred embodiment of a method disclosed herein the total of possible combinations of orthotics that are mass producible is one hundred twenty-five (125), and the orthotics are made from polypropylene material.

BRIEF DESCRIPTION OF THE DRAWINGS

The novel features of present invention, as well as the preferred embodiments of the present invention, both as to structure and operation, will be best understood from the accompanying drawings, taken in conjunction with the accompanying description, in which similar reference characters refer to similar parts, and in which:

FIG. 7 is a table showing exemplary ranges for thickness, width and arch height used by preferred embodiments of the present invention.

DETAILED DESCRIPTION OF THE PREFERRED EMBODIMENTS

The present invention provides unique orthotics (mass producible, custom-made shoe inserts) to correct and eliminate pain associated with biomechanical inefficiencies of an abnormal foot. The invention disclosed herein as shown through its preferred embodiments, further bridges the gap between the over-the-counter "one size fits all" shoe insoles and the in-office doctor-casted insoles (orthotics). The preferred orthotics of the present invention correct rather than merely accommodate the abnormal feet alignment due to the low arch height of the feet. Among the main objectives of these orthotics are to preserve the perpendicular alignment of the heel to the ground, align the midfoot to the central forward-moving motion of the foot, and align the forefoot parallel to the ground surface.

Figure 4A:
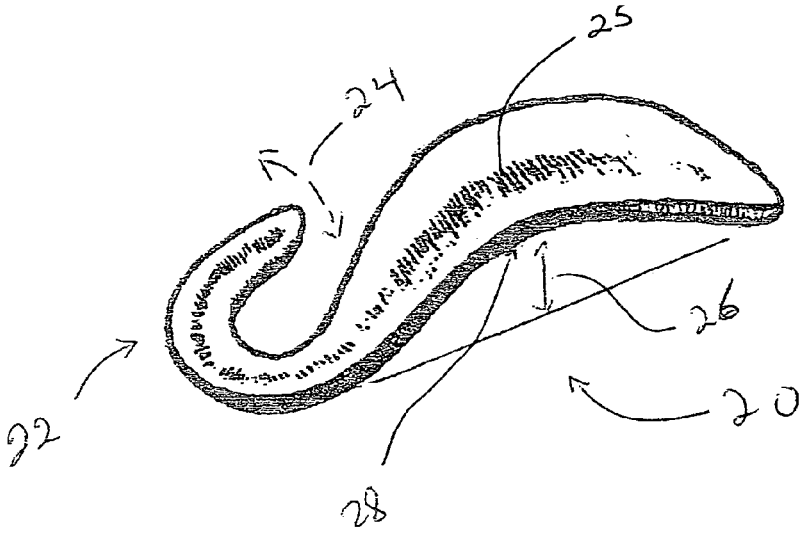
FIGS. 4A and 4B illustrate a first preferred embodiment of the present invention.
Figure 4B:
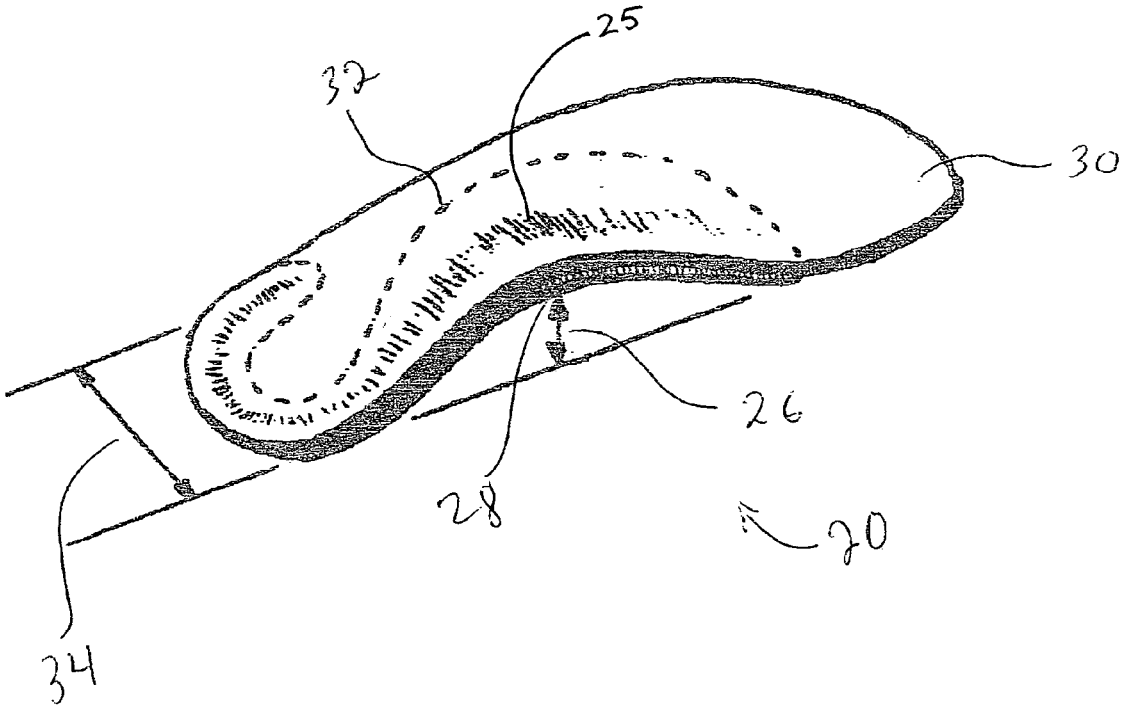

FIGS. 4A and 4B illustrate a first preferred embodiment of the present invention. The hook or the high-heel dress shoe orthotic 20 illustrated in FIG. 4A is made with a hook-shaped heel portion 22, located aft of a midfoot portion 25, that can be recoiled or flexed 24 to fit into most high heel, slim dress or slip-on shoes. The arch height 26 from the apex 28 to the ground is sized appropriately for correcting low-arched feet. The orthotic 20 snugly fits into slim dress shoes and provides a high enough arch to correct most abnormalities associated with flat feet.

FIG. 4B illustrates a hook design orthotic 20 of a first preferred embodiment of the present invention with an optional top cover 30 extending to the toes of a user. Other variations are certainly possible. For example, as illustrated with the dashed lines 32, the top cover 30 could match the exact shape of the original orthotic 20, rather than extending distally to the toes or completely covering the hook 22. The use of any top cover 30 depends on consumer preferences.

Figure 5A:
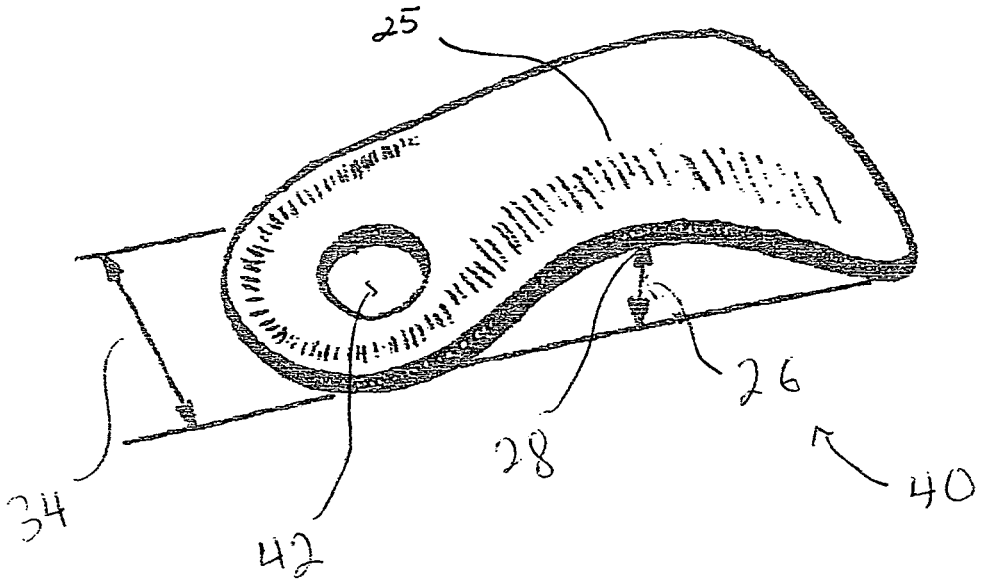
FIGS. 5A through 5D illustrate a second preferred embodiment of the present invention.
Figure 5B:
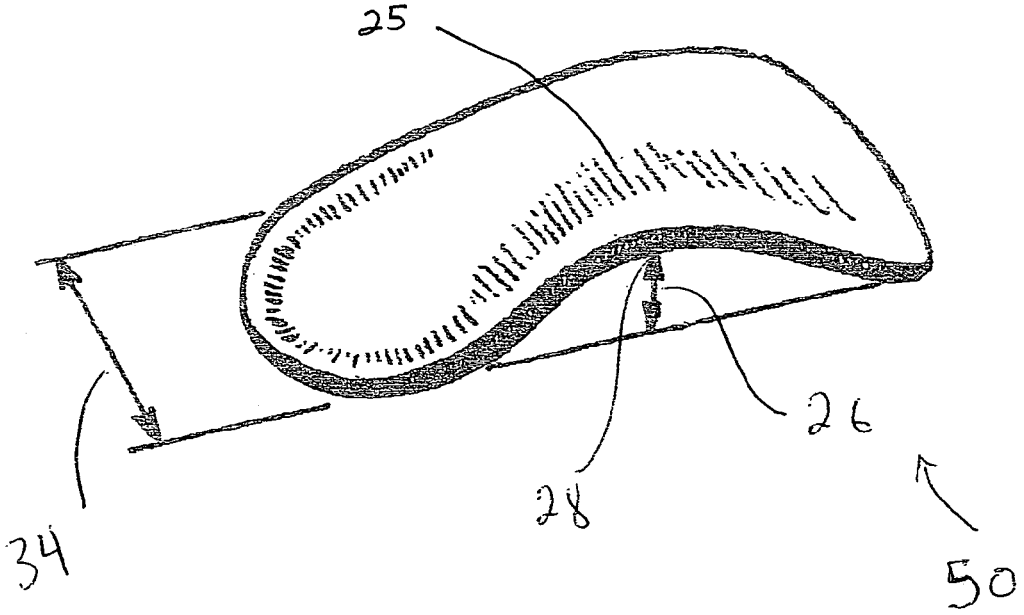

Referring now to FIGS. 5A through 5D, a second preferred embodiment of the present invention is illustrated. These hybrid orthotics 40, 50 of the second preferred embodiment of the present invention can be used with normal shoes, including athletic shoes, and may be made with or without a heel hole 42. FIG. 5A illustrates a hybrid, low impact sports/dress orthotic 40 with a heel hole 42, and no top cover. The hole 42 is used to take away some of the bulk and weight of the orthotic 40, and facilitates the removal of direct pressure on the bottom of the heel bone 4, thus alleviating pain for those with heel spur deformities. The dimensions of the heel hole 42 may be varied depending on a variety of different factors. FIG. 5B illustrates a hybrid medium impact sport orthotic 50 without a heel hole that can be used by heavier persons or those having a relatively active lifestyle.

Figure 5C:
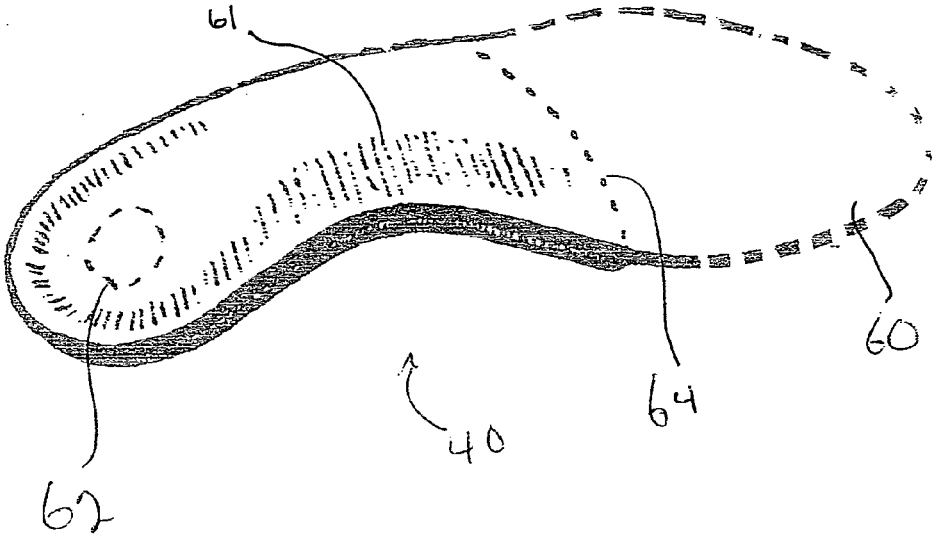
Figure 5D:
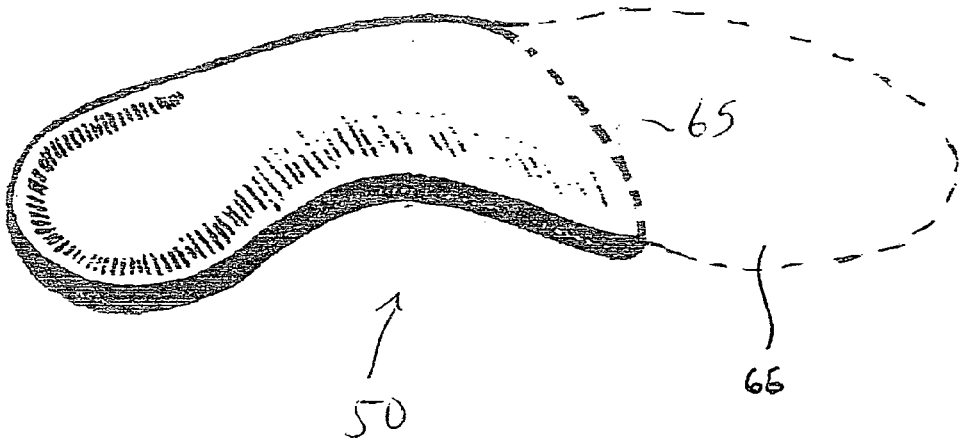

FIGS. 5C and 5D illustrate the two hybrid orthotics 40 and 50 with respective optional top covers 60, 66 that may optionally extend to the toes. As illustrated with the dashed lines 64, 65 the top cover 60, 66 could match the exact shape of the orthotic rather than extending over to the toes. In addition, the top cover 60 may include a recessed portion on the heel hole area 62 to help ease pain for those with heel spurs. The use of any top cover 60, 66 will depend on a user's idiosyncrasies.

Figure 6A:
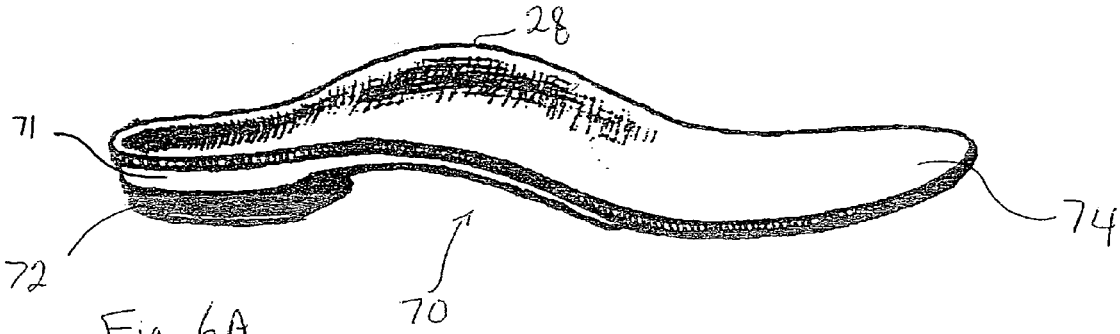
FIGS. 6A through 6F illustrate a third preferred embodiment of the present invention.
Figure 6B:
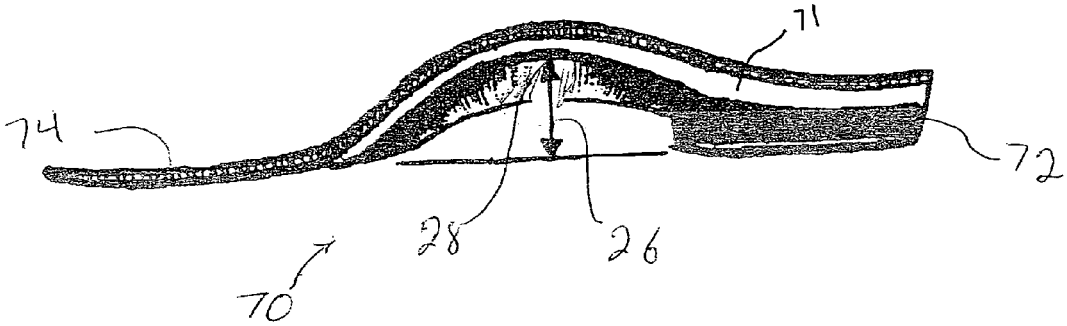
Figure 6C:
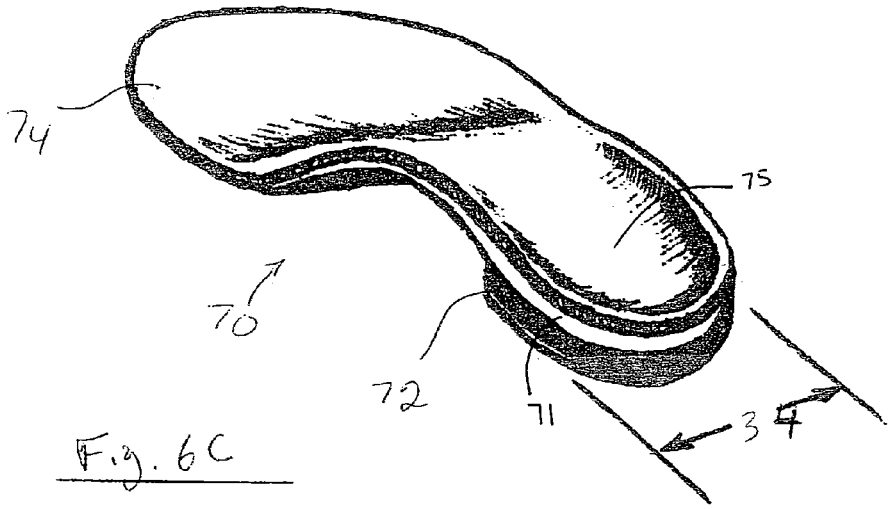

FIGS. 6A to 6F illustrate a third preferred embodiment of the present invention. Initially, FIGS. 6A to 6C illustrate a high impact sports orthotic 70 with optional external heel posting 72 and optional top cover 74 that extends to the toes beyond center portion 71. FIG. 6A illustrates an outside view while FIG. 6B an inside view of the orthotic 70 showing its arch height 26. The sports orthotic 70 of the third preferred embodiment of the present invention is different from the hybrid insoles of the second preferred embodiment of the present invention illustrated in FIGS. 5A to 5D in that it has a full heel cup 75, and a greater thickness (density), thus giving the orthotic 70 more strength.

The orthotic 70 is preferably used for high impact activities (including walking) and is more suitable for heavier persons. The optionally added heel posting 72, which may be comprised of crepe or like material, further enhances strength in the heel area.

Figure 6D:
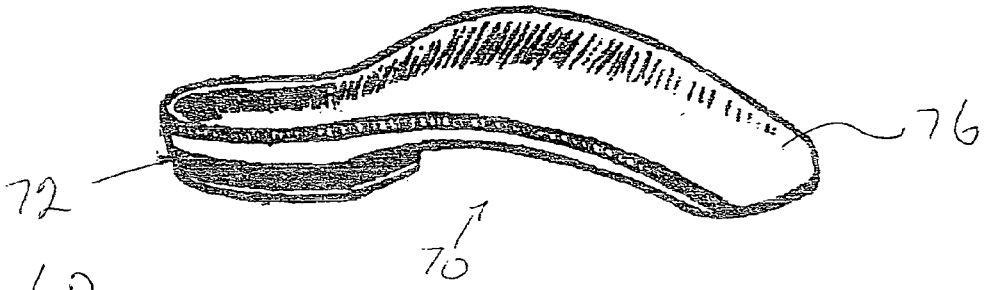
Figure 6E:
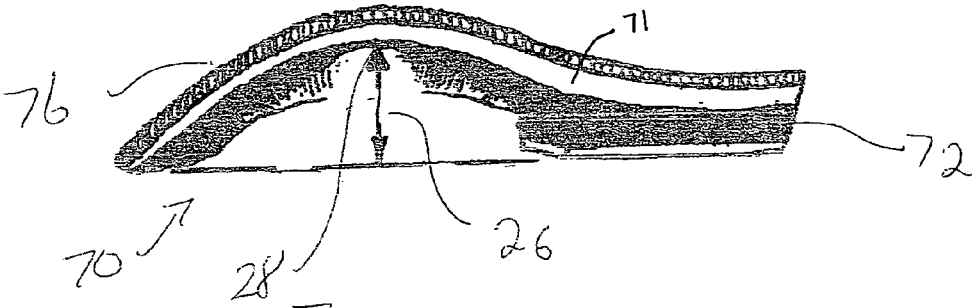
Figure 6F:
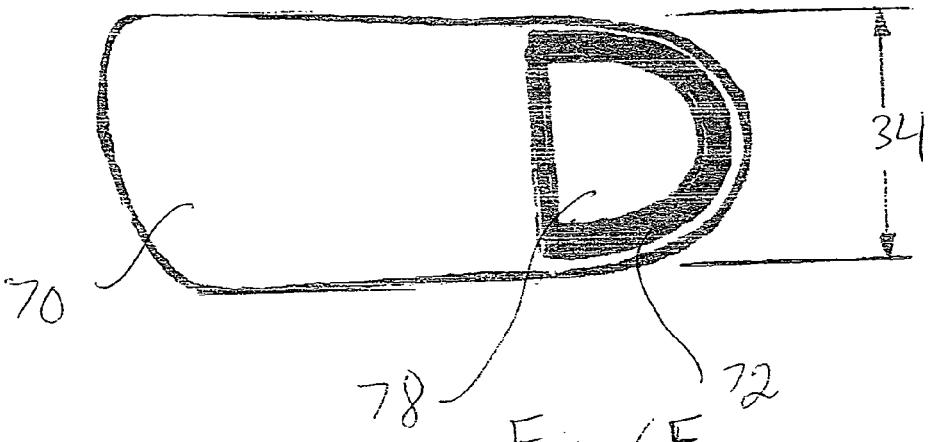

An angled view of the orthotic 70 showing its width 34 is illustrated in FIG. 6C. The high impact sports orthotic 70 having the optional external heel 72 and the optional top cover 76 that extend to cover over the orthotic 70 only, is illustrated in FIGS. 6D to 6F. FIG. 6D illustrates an outside view while FIG. 6E illustrates an inside view of the orthotic 70 showing its arch height 26. A bottom view of the orthotic 70 illustrated in FIG. 6F shows a heel cover 78 on the bottom side of heel 72. The heel cover 78 may be comprised of plastic or other rigid material of appropriate thickness.

The orthotics of the preferred embodiment of the present invention may be comprised of untreated, non-stressed, relieved (NSR) polypropylene or like material that is cost effective to produce and can provide full support for the weight of the person, while also providing "spring" like flexibility for comfort and further allowing for slight normal pronation during a midstance phase of a gait movement (or cycle). The gait cycle refers to the normal forward movement of the foot during a normal walk. A single gait cycle is comprised of a heel strike, midstance, and toe off phases. Each pair of orthotics can be constructed in different configurations with various thicknesses (or densities), widths, arch heights, and lengths to correct different gait cycle abnormalities. The average ranges and optimal values for all parameters addressed by the preferred orthotics of the present invention are illustrated in FIG. 7.

In the preferred embodiments manufactured using NSR polypropylene, a thickness (or density) of orthotics may also be classified into four broad categories of flexible, semi-flexible, stiff, and rigid, each with overlapping ranges of thickness or density. An orthotic within the flexible category may have a thickness as low as approximately 2.7781 mm to as high as approximately 3.5719 mm. The range of thickness or density for a semi-flexible orthotic may be as low as approximately 3.5719 mm to as high as approximately 4.3656 mm. A stiff classified orthotics thickness range may be as low as approximately 4.3656 mm to as high as approximately 5.1594 mm. Any value above approximately 5.1594 mm is considered (classified) by the preferred embodiments as rigid.

The width 34 of the orthotics of a preferred embodiment of the present invention, as illustrated in FIG. 7, may be classified into three broad categories of narrow, regular, and wide, each with overlapping width ranges to match foot and shoe size for a more exact orthotic fit. The orthotic width 34 is measured along the transverse arch, starting from the apex of the longitudinal or plantar arch 11 transversing across the foot to its outside edge. The width 34 within the narrow category may include a range from as low as approximately 40 mm to as high as approximately 85 mm, whereas a regular classified width 34 will have values as low as approximately 45 mm to as high as approximately 95 mm. The wide category is considered to be any value from approximately 50 mm to approximately 130 mm or greater.

The arch height 26 for each pair of orthotics of the preferred embodiments of the present invention will depend on the height (or flatness) of the plantar arch 11 of the foot. An orthotic with a low arch height 26 classification may have an arch height as low as approximately 10 mm to as high as approximately 30 mm. A medium classification arch height will have values as low as approximately 15 mm to as high as approximately 45 mm. The high category is considered any value from the 20 mm to 60 mm or higher. The actual length of the orthotic depends on the length of the foot from the heel to the end of the midfoot.

The number of combinations and permutations for a custom-made orthotic, and the deciding factors for the appropriate selections thereof with correct thickness, width, arch height, and length depends on a variety of factors such as age, weight, size of the foot, activity level, and the medical condition of the person. The age is important because, in general, the older the person the more difficult it will be for him (her) to quickly adapt to the use of the orthotic. This factor may be used to further modify or refine the orthotic arch height 26 based on the ability of the elderly to adapt to its use, rather than strictly identifying anatomical deformities of the foot and correcting these abnormalities associated with the person's plantar arch 11. The weight of the person determines the density (or thickness) and the type of an orthotic to be used. A medium arch height orthotic 50 with a stiff thickness level may be a better choice than a low arch height orthotic 40 with the same stiff thickness for a heavier person. The activity level of a person using any orthotic must also be considered. An active person with the same weight category as that of an inactive person may use a more rigid high impact sports orthotic 70 with appropriate arch height 26 and the optimal heels 72. In addition, information about the medical condition of the person will also help determine the actual type of orthotic best suitable for a person. For example, a heavy person with heel spurs would be much more comfortable using a low arch height orthotic 40 of stiff thickness compared to a person who does not have a similar condition.

Obtaining information about the anatomical attributes of the foot to proceed with the manufacture of an orthotic may be done in a variety of well known methods including the use of two dimensional foot impressions, a foam box having memory foams for a three dimensional impression of the foot, or any other method that would provide all required data about the foot while allowing for the production of a custom-made orthotic for that person.

Any orthotic can be made and used with or without a top cover 30, 60, 66, 74,. In the preferred embodiments, top covers are made from impact foam material that is either 1/16 of an inch or 1/8 of an inch poron, with a thickness depending on the weight of the person. A typical orthotic could have the poron material with leather, vinyl, or 1/16 of an inch or 1/8 of an inch spenco materials on its top surface. Other top covers may include the use of standard over-the-counter insoles. Although top covers do not need to be permanently fixed on the orthotics, they may be permanently affixed thereto using a variety of methods, including for example the use of cement glue.

In addition to the top covers 30, 60, 66, 74, metatarsal pads may also employed as a special padding placed in the front end of the orthotic to provide an extra padding proximal to the ball 12 of the foot 10. Metatarsal pads can correct problems associated with the ball 12 of the foot 10, and maybe used with all three preferred embodiments. Although the thickness and size of the metatarsal pads may be varied depending on the foot condition and size, in general, they are made of an approximately 1/8 inch thick poron.

While illustrative embodiments of the invention have been herein described, numerous variations and alternative embodiments will occur to those skilled in the art. For example, all averages and optimal values for the thickness or density of an orthotic can be varied depending on the strength and flexibility of material from which the orthotic is made. The high and low ranges and optimal values for thickness or density of an orthotic illustrated in FIG. 7 are merely averages based on the use of polypropylene as the orthotic construction material. The use of other material is certainly possible and will clearly change the illustrated embodiment averages and optimal values. The orthotic width averages and optimal values will be as different as there are different width foot sizes. Hence, the averages and the optimal value for the widths illustrated in FIG. 7 are merely averages, and should not be limiting. The arch heights illustrated in FIG. 7 depend on at least the anatomical or structural requirements of the arch height of a foot, which obviously varies from person to person. Hence, the values illustrated in FIG. 7 are merely averages and should not be limiting. Such variations and alternate embodiments are contemplated, and can be made without departing from the spirit and the scope of the invention.

A first preferred method of the present invention is a process of choosing particular orthotics for any particular person from a set of orthotics so that the orthotics can be mass produced. The methods described herein will bridge the gap between the inadequate "one size fits all," over-the-counter shoe insoles and the very expensive doctor-casted orthotics which may not even fit a person's feet.

Figures 8, 9:
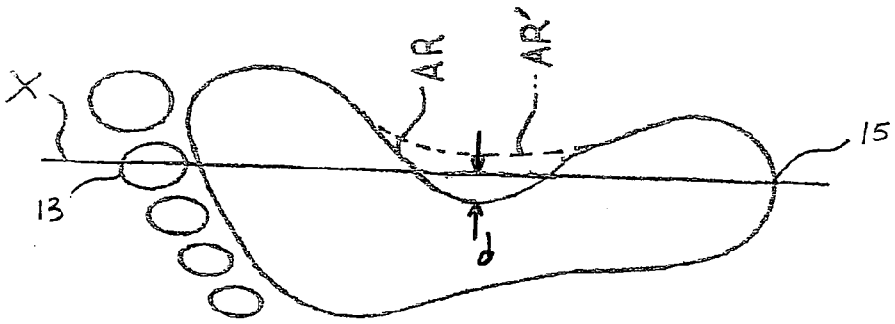
FIG. 8 is a form used by the preferred method of implementing the present invention.
FIG. 9 is an illustration showing the arch height measurement determination of the preferred method of the present invention.

Accordingly, in the preferred method of the present invention, certain facts are first gathered about a particular person. A form may be used as illustrated in FIG. 8. A person will provide physical characteristic information such as gender, age, weight, and activity level. For example, activity level may be determined by accessing a certain type of exercise along with number of minutes engaging in the exercise per week.

Next in the method, a person's footprint or foot impression is provided. Specifically in this particular embodiment, the footprint may be obtained by having the person stand on a piece of paper with wet bare feet for each of the person's left and right foot. The wet impression is then outlined in pen to provide the footprint, and the outlined footprint is returned to a manufacturer so orthotic dimensions can be selected and the orthotic manufactured appropriately.

Figure 1:
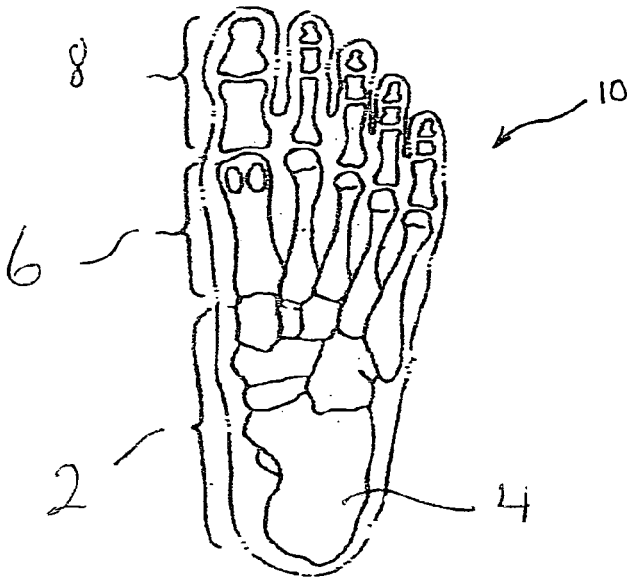
Fig. 1 (PRIOR ART)
FIG. 1 is a prior art illustration of a skeletal bone structure of a human foot.
Figure 2:
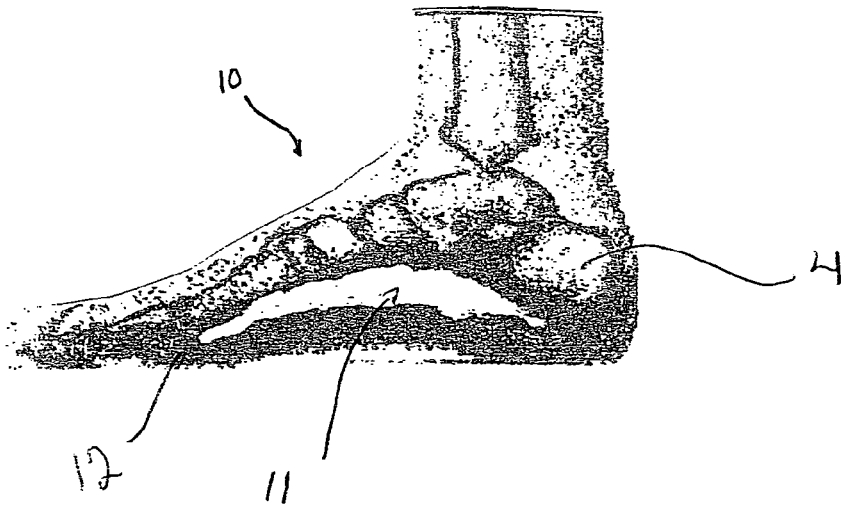
Fig. 2 (PRIOR ART)
FIG. 2 is a side view of a human foot illustrating its plantar arch.
Figure 3A:
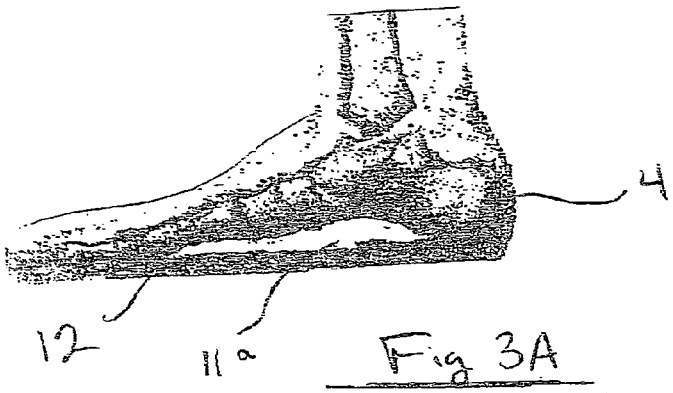
Fig 3A (PRIOR ART)
FIG. 3A is side view of a human foot illustrating a collapsing plantar arch.
Figure 3B:
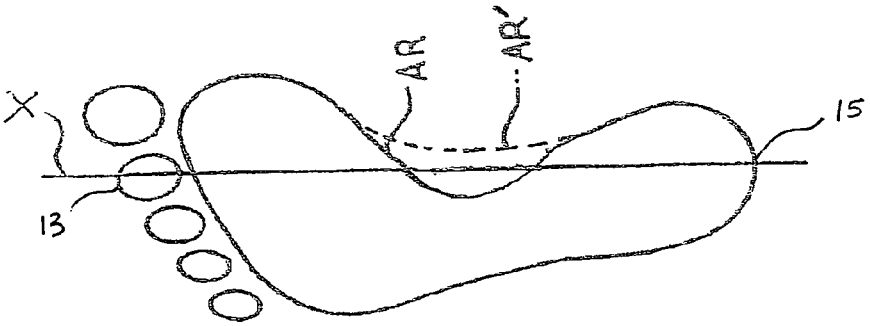
Fig. 3B (PRIOR ART)
FIG. 3B is a sketch of a footprint showing different arch lines that are proportional to plantar arch height.
Figure 3C:
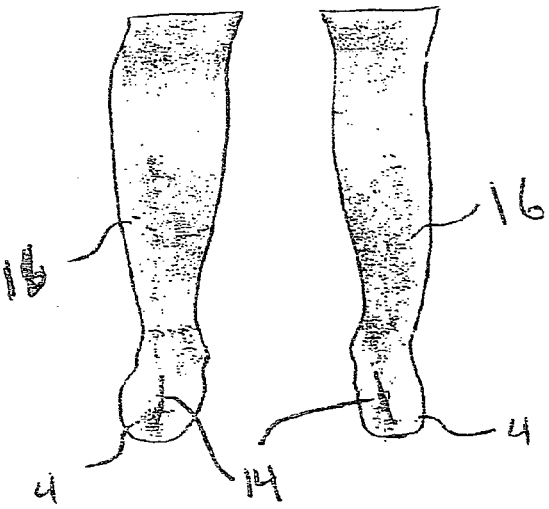
Fig. 3C (PRIOR ART)
FIG. 3C is a rearward view of a human's feet and legs illustrating abnormal foot alignment.

In the first preferred method, the orthotic's arch height is determined from the footprint, and is generally categorized as a low, medium-low, medium, medium-high, or high arch height. Specifically, a correlation is made from the footprint information, as illustrated in FIG. 3B, to a particular arch height required for a person. If the arch line AR is substantially concave and has a large radial dimension on the opposite side of the reference line X from the large toe, i.e., at its smallest distance from the side of the foot, then the arch is considered high. A common high arch dimension would be more than 15 mm. If the distance is between 15 mm and within 5 mm of the reference line, the arch is considered medium-high. If the distance is within 5 mm on either side of the reference line X, the arch is considered medium. If the distance is between 5 mm and 15 mm towards the proximal side of the large toe, the arch is considered medium-low. If the distance towards the proximal side of the large toe is more than 15 mm the arch is considered low. A thickness of material of the orthotics is selected from one of, for example: ⅛ inch, 9⁄64 inch, 3⁄16 inch, 11⁄64 inch, or ¼ inch. The particular thickness is determined primarily by the person's weight, but also by age and activity level, or special medical condition (i.e. diabetes). In the preferred embodiment, a thin, older, non-active person is provided a thinnest possible orthotic while a heavy, younger, active person is provided a thickest possible orthotic. The thickness of the orthotic will range based on those factors such that heavier, younger and more active people can benefit more with thicker thicknesses of the orthotics.

In this embodiment the width of the orthotic is made by the footprint. The orthotic width may generally fall in the category of narrow, narrow to regular, regular, regular to wide, and wide widths. Shoe size of the person may also be considered.

By way of example, the low, medium-low, medium, medium-high, or high arch heights according to the invention may be as follows: 10 mm, 20 mm, 25 mm, 30 mm, and 35 mm, respectively. Also as an example, the narrow, narrow to regular, regular, regular to wide, and wide widths may correspond to actual dimensions as follows: 40 mm, 50 mm, 60 mm, 70 nm, and 80 mm respectively.

The total number of possible orthotics will be the product of the possible number of arch heights, material thicknesses and orthotic widths. In a particular invention embodiment, there are five (5) of each type that yield a total number of one hundred twenty-five (125) different combinations of orthotics. The one hundred twenty-five (125) combinations could then be mass producible according to the present invention. It is further contemplated that the types of arch heights, thicknesses and widths could be expanded, narrowed or altered to yield a different total number of combinations.

As a working example, a particular person provides a footprint and further that person is a twenty-five (25) year old female, one hundred twenty-five (125) pounds and is moderately active. According to the method disclosed herein and considering the person's footprint, the particular specifications on the orthotic might result in a medium arch height (e.g. 30 mm), 3⁄16 inch thickness polypropylene material, and a medium width.

In another example of the method disclosed herein, a person provides a footprint and is a two hundred (200) pound male, twenty (20) years old and relatively inactive. A particular orthotic given this information may turn out to be a medium-low arch height (e.g. 25 mm), ¼ inch material thickness having a medium width.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Mass Producible Custom-Made Shoe Inserts as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A method for choosing particular orthotics for a particular person, the orthotics being mass producible, the method comprising:

gathering physical characteristics of the person;

providing the person's footprint information;

using the footprint information to select one of a plurality of arch heights;

using the person's physical characteristics to select one of a plurality of orthotic material thicknesses; and using the footprint information to select one of a plurality of orthotic widths, wherein a total of possible combinations of orthotics available is equal to an actual number for the plurality of arch heights times an actual number for the plurality of orthotic material thicknesses times an actual number of the plurality of orthotic widths, and wherein the total of possible combinations of orthotics is mass producible.

2. The method of claim 1, wherein the gathering physical characteristics of the person comprises:

gathering person's gender;

gathering person's age;

gathering person's weight;

gathering person's physical activity level; and gathering person's special medical condition.

3. The method of claim 1, wherein the providing the person's footprint information comprises:

having the person stand on a piece of paper with a wet bare left and right foot for approximately five (5) seconds forming a wet impression on the piece of paper; and outlining the wet impression on the piece of paper with a pen or a pencil.

4. The method of claim 1 wherein the plurality of arch heights comprise:

low arch height approximately equal to 10 mm;

medium-low arch height approximately equal to 20 mm;

medium arch height approximately equal to 25 mm;

medium-high arch height approximately equal to 30 mm; and high arch heights arch approximately equal to 35 mm.

5. The method of claim 1 wherein the plurality of orthotic material thicknesses comprise:

1/8 inch;

9/64 inch;

3/16 inch;

11/64 inch; and

1/4 inch thicknesses.

6. The method of claim 1 wherein the plurality of widths comprise:

narrow width approximately equal to 40 mm;

narrow to regular width approximately equal to 50 mm;

regular width approximately equal to 60 mm;

regular to wide width approximately equal to 70 mm; and wide width approximately equal to 80 mm.

7. The method of claim 1 wherein the total of possible combinations is one hundred twenty-five (125).

8. The method of claim 1 wherein the orthotics are made from polypropylene material.

* * * * *